US007063556B1

(12) United States Patent
Wong et al.

(10) Patent No.: US 7,063,556 B1
(45) Date of Patent: Jun. 20, 2006

(54) ELECTRICAL CABLE CONNECTOR

(76) Inventors: Memie Mei Mei Wong, 7th Floor, Block 2, Leader Industrial Centre 188-202 Texaco Road, Tsuen Wan, New Territories (HK); Sam Yun Sum Wong, 7th Floor, Block 2, Leader Industrial Centre 188-202 Texaco Road, Tsuen Wan, New Territories (HK)

( * ) Notice: Subject to any disclaimer, the term of this patent is extended or adjusted under 35 U.S.C. 154(b) by 0 days.

(21) Appl. No.: 11/007,248

(22) Filed: Dec. 9, 2004

(51) Int. Cl.
*H01R 4/24* (2006.01)

(52) U.S. Cl. ..... 439/412; 439/411; 439/413; 439/417

(58) Field of Classification Search ..... 439/412, 439/411, 413, 419, 459, 409, 417
See application file for complete search history.

(56) References Cited

U.S. PATENT DOCUMENTS 2,700,142 A * 1/1955 Benander ..... 439/413
5,203,716 A * 4/1993 Martucci et al. ..... 439/411
RE35,325 E * 9/1996 Wass et al. ..... 439/412
6,010,356 A * 1/2000 Hale et al. ..... 439/459
6,135,808 A * 10/2000 Hale et al. ..... 439/459
6,196,862 B1 * 3/2001 Dooley ..... 439/412
6,328,593 B1 * 12/2001 Chang et al. ..... 439/419
6,364,690 B1 * 4/2002 Nehm-Engelberts ..... 439/412
6,604,956 B1 * 8/2003 Ruiz et al. ..... 439/409
2004/0156198 A1 8/2004 Chen

FOREIGN PATENT DOCUMENTS

EP 0 726 623 8/1996

* cited by examiner

*Primary Examiner*—Tulsidas C. Patel
*Assistant Examiner*—Harshad C Patel
(74) *Attorney, Agent, or Firm*—Leydig, Voit & Mayer, Ltd.

(57) ABSTRACT

An electrical connector for use on an electrical cable, for drawing power from the cable, includes a body having upper and lower sides, the lower side including a channel which opens to the exterior on the lower side such that the cable can be laterally inserted into the channel from the lower side, a clamp in the channel for clamping the cable in the channel, and an operator on the upper side for operating the clamp, the operator being operable through a screw action. Also included is a pair of conductors, each conductor having a sharp lower end for piercing the cable clamped in the channel to make contact with a respective conductive core of the cable, and an upper end for external electrical connection on the upper side.

20 Claims, 3 Drawing Sheets

ELECTRICAL CABLE CONNECTOR

The present invention relates to an electrical cable connector that is particularly but not exclusively useful for power connection of a garden lamp or landscape lighting system.

BACKGROUND OF THE INVENTION

Along a low-voltage power supply cable, need may arise to draw off power from the cable at a specific position for powering an electrical device, such as a light/lamp in the garden where lighting is desired. A special type of electrical connector is used for this purpose, which is mounted on the cable at that position and is then screwed tight to pierce a pair of sharp pins into the cable cores for extracting power.

Connectors of this type are known in general, such as the one disclosed in U.S. Pat. No. 5,601,448. This connector must be taken apart before it can be mounted onto the cable, and this is not particularly user convenient. There are other shortcomings, for example an adaptor must be used to cope with a specific cable width and at least two those are supplied for use, leaving the unused-one(s) loose.

The invention seeks to mitigate or at least alleviate one or more of these shortcomings by providing a new or improved cable connector of the type concerned.

SUMMARY OF THE INVENTION

According to the invention, there is provided an electrical connector for use on an electrical cable for drawing off power therefrom, comprising a body having a first side including a channel which opens to the exterior on the same side such that the cable can be laterally inserted into the channel from that side, a clamp in the channel for clamping the cable in the channel, and an operator for operating the clamp through a screw action. The operator is provided on a second side of the body distinct from the first side. There is also a pair of conductors, each having a sharp first end for piercing into the cable clamped in the channel to make contact with a respective conductive core thereof and a second end for external electrical connection.

Preferably, the second side of the body is opposite to the first side.

Preferably, the second ends of the conductors are provided for external electrical connection on the second side of the body.

For convenience of use, the electrical cable connector has a one-piece structure throughout the process of it being connected to the cable, without the need to be taken apart into separate pieces.

In a preferred embodiment, the clamp comprises a pair of left and right clamp members that are movable by the operator symmetrically with respect to the conductors such that the cable will be centered and clamped with its cores substantially in alignment with the first ends of the corresponding conductors.

More preferably, the clamp members are arranged to be moved by the operator to reduce the effective width and depth of the channel relative to the cable such that the cable will be centered and clamped substantially at the same time.

Further more preferably, each clamp member is slidably supported by the body for movement by the operator linearly towards a base of the channel at an acute angle, against which base the cable is to be clamped.

Advantageously, the channel has a slightly protruding central rib on its base to assist centering of the cable upon being clamped.

Preferably, the clamp members have identical construction and are positioned in symmetry with respect to the conductors.

In a preferred embodiment, the operator comprises a core in engagement with the clamp through the body and a knob on the second body side in engagement with the core for turning to move the core to thereby operate the clamp.

More preferably, the core has a bifurcated end facing in opposite direction from the channel, the end having external screw threads engaging the knob for movement thereby.

Further more preferably, the second side of the body includes a hub flanked by the bifurcated end of the core, which hub mounts the conductors.

It is preferred that the core is in sliding engagement with the clamp for moving, and thus operating, the clamp in a direction across the first and second sides of the body and simultaneously in a direction perpendicular thereto.

In a preferred embodiment, the channel has a base against which the cable is to be clamped and within which the first ends of the conductors are initially positioned, the base being movable by the operator upon continual operation after the cable has been clamped towards the conductor ends, thereby pressing the clamped cable against the conductor ends to be pierced thereby.

More preferably, the body has separate first and second parts on its first and second sides respectively, the first part including the channel and the second part including the conductors, and a spring co-acts between the body parts for compression upon said continual operation of the operator to allow said movement of the base towards the first conductor ends.

For convenience of use, the second end of each conductor comprises an inwardly inclined grip section co-operable with an adjacent section for gripping and thus connecting an end of an electrical cable conductor upon entrance.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
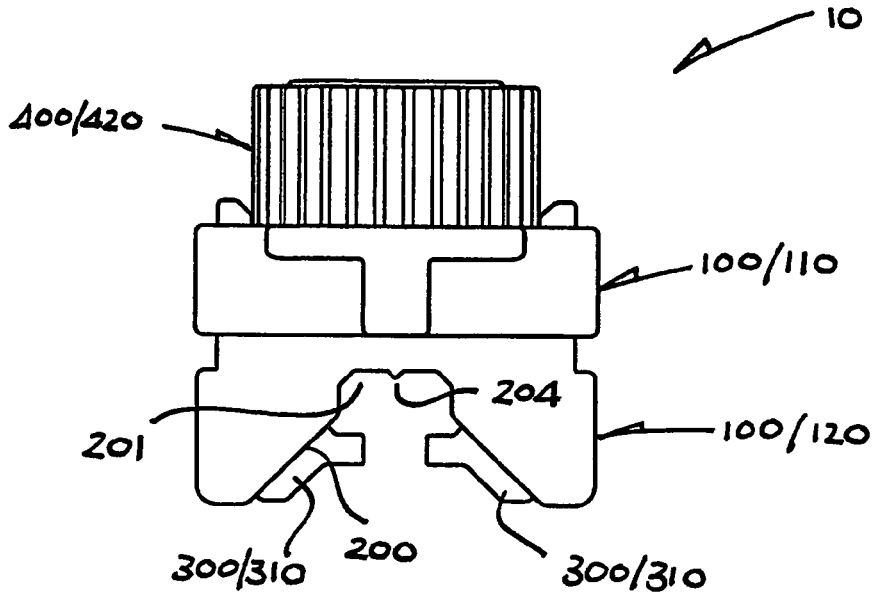
FIG. 1 is a side view of an embodiment of an electrical cable connector in accordance with the invention.
Figure 2:
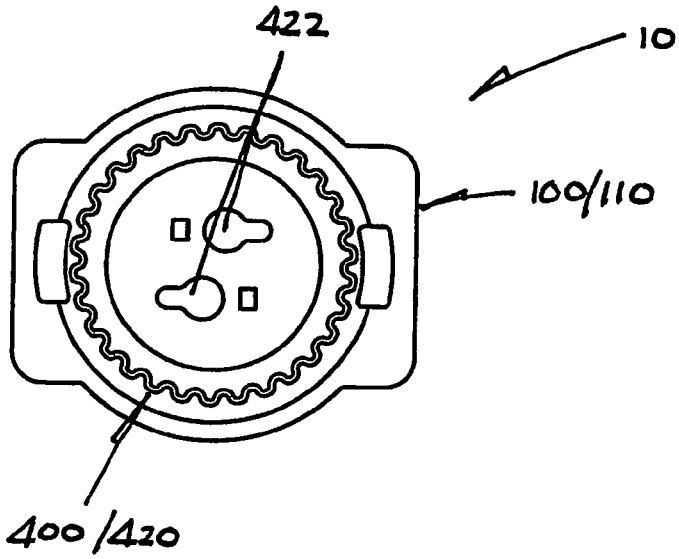
FIG. 2 is a top plan view of the connector of FIG. 1.
Figure 3:
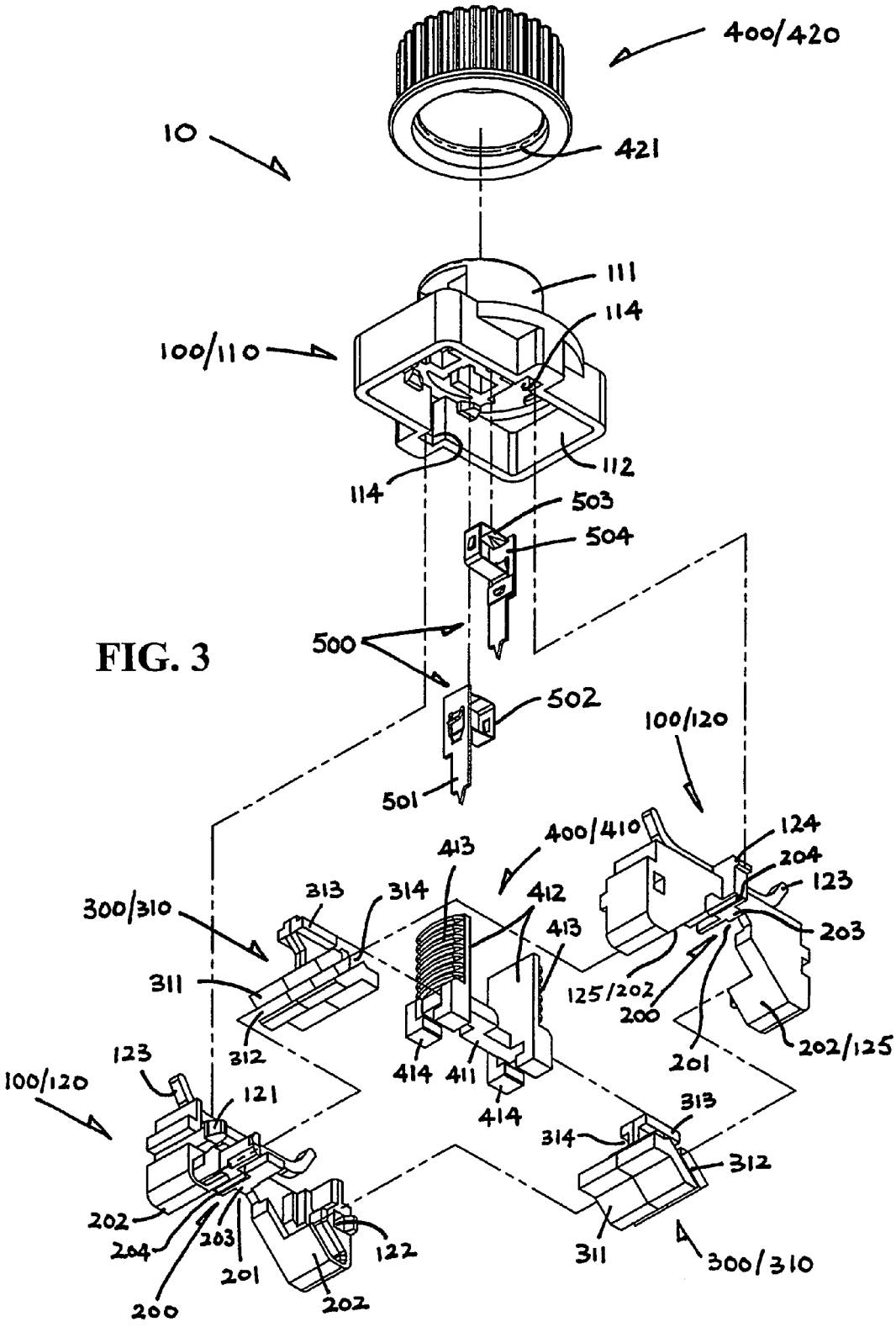
FIG. 3 is an exploded perspective view of the connector of FIG. 1.

Referring to the drawings, there is shown an electrical connector 10 embodying the invention for use on an electrical cable 20 that is connected to a low-voltage power supply, of say 12V, for drawing off power from that cable 20. The cable 20 typically comprises a pair of conductive cores 22 protected by an insulating sheath 21.

The subject connector 10 has a plastic body 100 formed by an upper part 110 and a pair of lower parts 120 which includes a channel 200 for engaging upon the cable 20, a plastic clamp 300 in the channel 200 for clamping onto the cable 20, and a plastic operator 400 on the upper body part 110 for operating the clamp 300. There is also a pair of conductive copper pins 500 located symmetrically in the body 100 for making electrical contact with respective cable cores 22 upon operation of the operator 400.

The upper body part 110 is generally rectangular box-like, including a rectangular open bottom 112 and a cylindrical central hub 111 upstanding from an apertured upper wall 113 of the body part 110. There is also a pair of slots 114 on the inner surfaces of opposite side walls of the body part 110.

The lower body parts 120 have identical construction and are snapped side-by-side together by means of respective pairs of hooks 121 and apertures 122 at opposite ends. Their channel 200 has a symmetrical V-shape generally and opens to the exterior downwardly such that the cable 20 can be laterally inserted into the channel 200 from below. The channel 200 has a pair of 45° inclined left and right sides 202 and includes, at its apex, a considerably smaller generally rectangular base channel 201 within which the cable 20 is to be gripped firmly by the clamp 300 against a base 203 of the channel 201.

Each channel side 202 is provided by correspondingly inclined walls 125 of the lower body parts 120 meeting along their interface. A slightly protruding central rib 204 on the channel base 203 is useful to assist centering of the cable 20 within the base channel 201 when the cable 20 is being clamped.

Each of the lower body parts 120 includes a flat spring bow 123 lying horizontally along its top, and a hook 124 at mid-length of the bow 123 and on its outer side. The combined lower body parts 120 are inserted from below into the upper body part 110 through the open bottom 112 thereof, with their side hooks 124 snapped with the slots 114 respectively of the lower body parts 120.

This results in assembling of the lower body parts 120 with the upper body part 110, which however remain slidable relative to the upper body part 110 to a limited extent by reason of resilient deformation of the spring bows 123 that bear upwardly against the upper wall 113 of the body part 110.

The clamp 300 has a pair of identical left and right members 310 that are supported by respective ends of the combined lower body parts 120 on opposite sides of the channel 200. Each clamp member has a 45° inclined base 311 which has two layers separated by a planar gap 312, and includes a T-sectioned top 313 which extends horizontally above the base 311 and defines a 90° recessed step 314 therewith. The clamp member 310 is slidably supported by the gap 312 of its base 311 riding upon the adjoining walls 125 (i.e. the channel side 202) at the corresponding end of the lower body parts 120, with its recessed step 314 facing the base channel 201.

Figure 6:
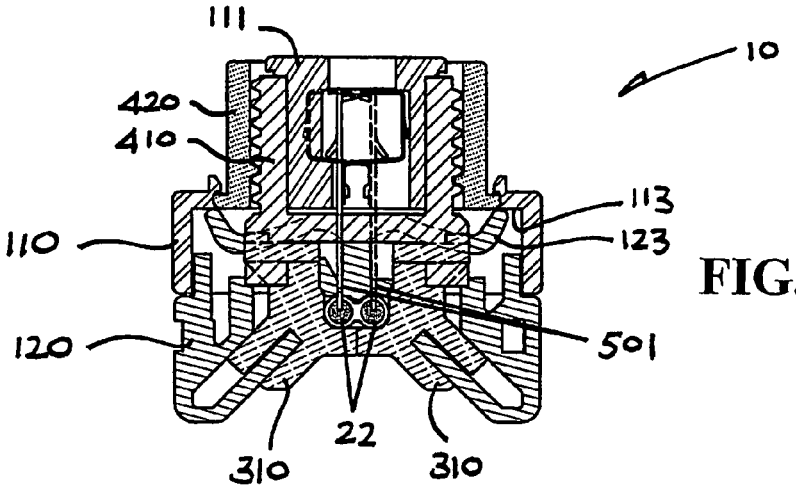
FIG. 6 is a cross-sectional side view of the connector of FIG. 5, upon electrical connecting the cable.
Figure 5:
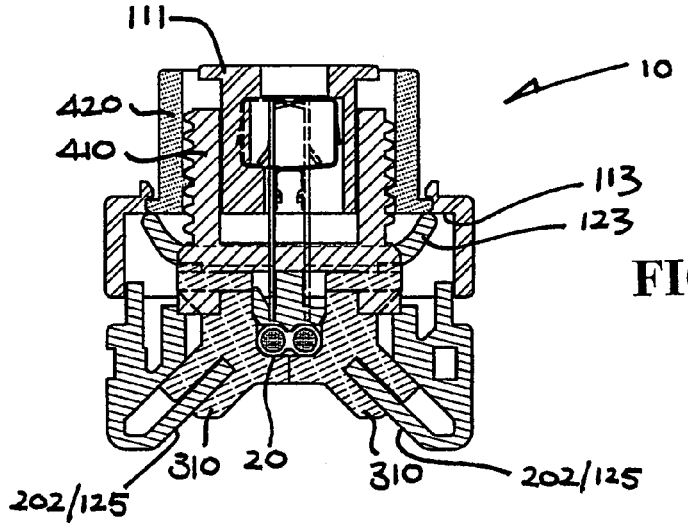
FIG. 5 is a cross-sectional side view of the connector of FIG. 4, upon clamping onto the cable.
Figure 4:
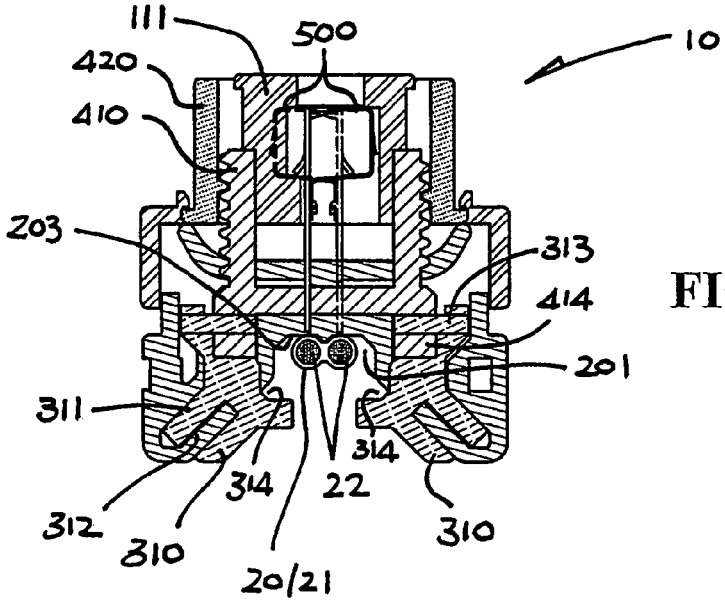
FIG. 4 is a cross-sectional side view of the connector of FIG. 1, about to clamp onto an electrical cable.

The arrangement is such that each clamp member 310 is slidable, by the operator 400, linearly along the lower body parts 120 to have its recessed step 314 movable at 45° towards, or away from, the base channel 201 (from FIGS. 4 to 6, or vice versa).

The operator 400 has a core 410 in engagement with the clamp 300 through the upper body part 110, and includes a ring knob 420 on the upper body part 110 engaging the core 410 for turning to move the core 410 upwards and downwards through a screw action to thereby operate the clamp 300.

The knob 420 is externally ribbed to assist gripping and includes a single turn of internal screw thread 421. The core 410 has a horizontal oblong base 411 and a vertical bifurcated end 412 projecting upwardly from opposite ends of the base 411, i.e. facing in opposite direction from the channel 200. The core end 412 is formed with external screw threads 413, and is inserted from below into the upper body part 110 and then through its upper wall 113 such that opposite prongs of the end 412 flank the body hub 111. The knob 420 is disposed around the hub 111 and hence screwingly engaged with the core end 412 for turning to slide the core 410 gradually up and down.

Each end of the base 411 of the core 410 includes a pair of confronting bottom hooks 414 with a gap therebetween aligned horizontally lengthwise of the base 411, which slidably engages the T-sectioned top 313 of a respective clamp member 310. This engagement permits simultaneous sliding of both clamp members 310 in opposite directions as the core 410 is moved up and down by the turning knob 420. The clamp members 310 are thus movable during operation in a direction across the upper and lower body parts 110 and 120 (i.e. vertically) and simultaneously in a direction perpendicular thereto (i.e. horizontally).

As a result, upon action of the operator 400, the clamp members 310 are moved at the same time and symmetrically (relative to the conductive pins 500) at 45° towards (or away from) the base channel 201, with their recessed steps 314 reducing the effective width and depth of the base channel 201 to thereby simultaneously center and clamp the cable 20 in the channel 201, with its cores 22 in alignment with the corresponding pins 500 (from FIGS. 4 to 6).

Each of the conductive pins 500 has a sharp lower end 501 for piercing into the cable 20 clamped in the base channel 201 to make contact with a respective cable core 22, and a looped upper end 502 for external electrical connection. The pin 500 is mounted with its upper end 502 in the body hub 111 and its lower end 501 projecting therefrom past the core base 411 into the combined lower body part 120. The pin end 501 reaches just short of, from inside, the base 203 of the base channel 201, such that the end 501 does not stick out from the base 203 into the channel 201, albeit only initially (FIG. 4).

Immediately upon fixing of the electrical cable 20 in the base channel 201 by the clamp 300 (FIG. 5), continual tightening of the knob 420 will compress the upper and lower body parts 110 and 120 further together via the core 210 and the tightened clamp 300, against the action of the spring bows 123. As the lower body parts 120 are drawn further into the upper body part 110, the channel 201 (with the cable 20) is pressed towards and against the sharp ends 501 of the conductive pins 500, whereby the ends 501 cut and pierce through into the cable 20 and make contact with its cores 22 (FIG. 6).

There are advantages for not exposing or sticking out the sharp ends 501 of the conductive pins 500 from the channel base 203 before the cable 20 is clamped. If the sharp pin ends 501 protrude when the channel 201 is vacant, such sharp ends 501 may cause injury to fingers, and while the cable 20 is being clamped they would hinder positioning of the cable 20 in the channel 201 and/or cause damage to the cable insulation 21.

The upper ends 502 of the conductive pins 500 are aligned with and accessible through respective holes 422 in the top surface of the body hub 111. The loop at each pin end 502 comprises an inwardly inclined grip section 503 that will be deflected further inwards by the end of an external electrical cable conductor inserted into the relevant hole 422, whereby the entrant end of that cable conductor is automatically gripped, against withdrawal, by the grip section 503 against an adjacent co-operating fixed section 504.

The subject electrical connector 10 offers quick, easy and convenient connection of a garden lamp, for example, to the electrical cable 20 for power supply at any desired position. The connector 10 remains a one-piece structure throughout the process of it being connected to the cable 20, without the need to be taken apart into separate pieces, being immediately ready for use without prior complication. The plug-in type terminal connection to the conductive pins 500 eliminates the need to use a hand tool i.e. screwdriver.

In the described embodiment, the operator 400 is provided on the top side of the subject connector 10 for operating the clamp 300 on the opposite side. It is envisaged that the operator 400 may be provided on any other side, such as the left or right side, that is distinct or different from the side including the clamp 300 and channel 200, so long as the channel 200 will remain open for immediately mounting onto a power supply cable 20 without the need of any dissembling and re-assembling works.

The invention has been given by way of example only, and various other modifications of and/or alterations to the described embodiment may be made by persons skilled in the art without departing from the scope of the invention as specified in the appended claims.

What is claimed is:

1. An electrical connector for drawing power from an electrical cable, the electrical connector comprising:

a body having a first side including a channel which opens on the first side so that an electrical cable can be laterally inserted into the channel from the first side;

a clamp in the channel for clamping the electrical cable in the channel, wherein the clamp comprises left and right clamp members;

an operator for operating the clamp through a screw action, the operator being located on a second side of the body, distinct from the first side, and moving the left and right clamp members to reduce effective width and depth of the channel relative to the electrical cable so that the electrical cable is centered and clamped substantially simultaneously; and a pair of conductors, each conductor having a sharp first end for piercing insulation of the electrical cable when clamped in the channel to make contact with a respective conductive core of the electrical cable, and a second end for external electrical connection, wherein the left and right clamp members are located symmetrically with respect to the conductors so that the electrical cable is centered and clamped with the conductive cores substantially in alignment with the first ends of the corresponding conductors.

2. The electrical cable connector as claimed in claim 1, wherein the second side of the body is opposite the first side.

3. The electrical cable connector as claimed in claim 1, wherein the second ends of the conductors are located, for external electrical connection, on the second side of the body.

4. The electrical cable connector as claimed in claim 1, wherein each of the left and right clamp members is slidably supported by the body for linear movement by the operator, towards a base of the channel, at an acute angle, so that the electrical cable is clamped against the base.

5. The electrical cable connector as claimed in claim 1, wherein the channel has a protruding central rib to assist centering of the electrical cable being clamped.

6. The electrical cable connector as claimed in claim 1, wherein the left and right clamp members have identical construction and are positioned symmetrically with respect to the conductors.

7. The electrical cable connector as claimed in claim 1, wherein the operator comprises a central core in engagement with the clamp through the body and a knob on the second side in engagement with the core for rotation to move the central core and operate the clamp.

8. The electrical cable connector as claimed in claim 7, wherein the central core has a bifurcated end facing in a direction opposite from the channel, the end having external screw threads engaging the knob and moving upon rotation of the knob.

9. The electrical cable connector as claimed in claim 8, wherein the second side of the body includes a hub flanked by the bifurcated end of the central core, the conductors being mounted on the hub.

10. The electrical cable connector as claimed in claim 7, wherein the central core is in sliding engagement with the clamp for moving, and thus operating, the clamp in a direction along the first and second sides of the body and, simultaneously, in a direction perpendicular to the first and second sides of the body.

11. The electrical cable connector as claimed in claim 1, wherein the channel has a base against which the electrical cable is to be clamped and within which the first ends of the conductors are initially positioned, the base being movable by the operator upon continual operation, after the electrical cable has been clamped, towards the first ends, thereby pressing the electrical cable against the first ends, for piercing of the insulation.

12. The electrical cable connector as claimed in claim 11, wherein the body has separate first and second parts on the first and second sides, respectively, the first part including the channel and the second part including the conductors, and including a spring acting between the first and second body parts and that is compressed, upon continual operation of the operator, in movement of the base towards the first ends.

13. The electrical cable connector as claimed in claim 1, wherein the second end of each conductor comprises an inwardly inclined grip section co-operable with an adjacent section for gripping and thus connecting an end of an electrical cable conductor.

14. An electrical connector for connecting conducting cores of a first electrical cable to respective conducting cores of a second electrical cable without severing of the first electrical cable, the connector comprising:

a body having a first side that includes a channel for receiving and clamping of a first electrical cable;

a clamp operatively arranged within the channel and slidably engaged with the body, having a first position opening the channel, while the clamp is engaged with the body, for lateral insertion of the first electrical cable in the channel, and a second position closing the channel, while the clamp is engaged with the body, and clamping the first electrical cable against the body;

an operator for sliding the clamp, while engaged with the body, between the first and second positions, the operator being located on an opposite side of the body from the channel; and a pair of conductors, each conductor having a sharp first end for piercing insulation of the first electrical cable when clamped within the channel and making contact with a conducting core of the first electrical cable, and a second end for electrical connection to a conducting core of a second electrical cable.

15. The electrical cable connector as claimed in claim 14, wherein the second ends of the conductors are located, for external electrical connection, on the second side of the body.

16. The electrical cable connector as claimed in claim 14, wherein the clamp comprises left and right clamp members movable by the operator from the first position toward the second position, reducing width and depth of the channel relative to the first electrical cable.

17. The electrical cable connector as claimed in claim 16, wherein the left and right clamp members have identical construction.

18. The electrical cable connector as claimed in claim 14, wherein the operator comprises a central core in engagement with the clamp through the body and a knob on the second side in engagement with the core for rotation to move the central core and operate the clamp.

19. The electrical cable connector as claimed in claim 18, wherein the central core has a bifurcated end facing in a direction opposite from the channel, the end having external screw threads engaging the knob and moving upon rotation of the knob.

20. The electrical cable connector as claimed in claim 18, wherein the central core is in sliding engagement with the clamp for moving, and thus operating, the clamp in a direction along the first and second sides of the body and, simultaneously, in a direction perpendicular to the first and second sides of the body.

* * * * *